US009919401B2

(12) United States Patent
Hsu et al.

(10) Patent No.: US 9,919,401 B2
(45) Date of Patent: Mar. 20, 2018

(54) HANDHELD ABRADER

(71) Applicant: TECHWAY INDUSTRIAL CO., LTD., Taichung (TW)

(72) Inventors: Chih Hua Hsu, Taichung (TW); Jui Heng Lin, Taichung (TW); Chen Chen Cheng, Taichung (TW)

(73) Assignee: Techway Industrial Co., Ltd., Taichung (TW)

( * ) Notice: Subject to any disclaimer, the term of this patent is extended or adjusted under 35 U.S.C. 154(b) by 217 days.

(21) Appl. No.: 15/058,203

(22) Filed: Mar. 2, 2016

(65) Prior Publication Data

US 2017/0252888 A1 Sep. 7, 2017

(51) Int. Cl.
*B24B 23/02* (2006.01)
*B25F 5/00* (2006.01)

(52) U.S. Cl.
CPC ..... *B24B 23/028* (2013.01); *B25F 5/001* (2013.01)

(58) Field of Classification Search
CPC ..... B24B 23/028; B25F 5/001
USPC ..... 451/359
See application file for complete search history.

(56) References Cited

U.S. PATENT DOCUMENTS

2009/0239451 A1* 9/2009 Geiser ..... B24B 23/03 451/58
2010/0009608 A1* 1/2010 Lo ..... B24B 23/028 451/357
2013/0157550 A1* 6/2013 Ikuta ..... B24B 23/028 451/451
2017/0008160 A1* 1/2017 Simma ..... B25F 5/006

* cited by examiner

*Primary Examiner* — Marc Carlson
(74) *Attorney, Agent, or Firm* — Alan D. Kamrath; Kamrath IP Lawfirm, P.A.

(57) ABSTRACT

A handheld abrader has a body, a driving device, an eccentric device, and a grinding tray. The body has a handle and a gun body. The driving device is mounted in the gun body and has a driving shaft. The eccentric device is connected to the driving device and has a transmitting sheath, a transmitting shaft, and an eccentric sleeve. The transmitting sheath is connected to the driving shaft and has two positioning recesses and a receiving chamber. The transmitting shaft has at least one engaging face. The eccentric sleeve is movably mounted around the transmitting sheath and has at least one positioning slice abutting against the transmitting sheath in one of the positioning recesses and an engaging ring mounted in the eccentric sleeve, mounted around the transmitting shaft, and having at least one pressing arm selectively pressed against the transmitting shaft at the at least one engaging face.

20 Claims, 8 Drawing Sheets

HANDHELD ABRADER

BACKGROUND OF THE INVENTION

1. Field of the Invention

The present invention relates to a handheld abrader, and more particularly relates to a handheld abrader that may reduce the cost of use and may be adjusted according to the user's need conveniently to increase the applicability of the handheld abrader.

2. Description of Related Art

When a surface of metal needs cleaning, decontaminating or descaling, a grinding tray is connected to and rotated with a conventional handheld abrader to grid or polish the surface of metal to provide a cleaning, decontaminating or descaling effect to the metal. The conventional handheld abrader has a body, a driving device and a grinding tray. The body is gun shaped and has a handle and a gun body. The gun body is connected to the handle and has a mounting chamber. The driving device is mounted in the mounting chamber of the gun body and has a driving shaft. The driving shaft is rotatably connected to the body by the driving device and has an end extending out of a front side of the gun body. The grinding tray is connected to the end of the driving shaft and is rotated with the driving shaft relative to the body.

However, the conventional handheld abrader may provide a cleaning, decontaminating or descaling effect to the metal. Since the driving shaft of the conventional handheld abrader has a specific torque, users need to replace or buy handheld abraders with different torques when the metal needs to be grinded or polished by different ways such as rough grinding or fine grinding, and this may increase the cost of use and may limit the applicability of the conventional handheld abrader.

To overcome the shortcomings, the present invention provides a handheld abrader to mitigate or obviate the aforementioned problems.

SUMMARY OF THE INVENTION

The main objective of the present invention is to provide a handheld abrader that may reduce the cost of use and may be adjusted according to the user's need conveniently to increase the applicability of the handheld abrader.

The handheld abrader in accordance with the present invention has a body, a driving device, an eccentric device, and a grinding tray. The body has a handle and a gun body. The driving device is mounted in the gun body and has a driving shaft. The eccentric device is connected to the driving device and has a transmitting sheath, a transmitting shaft, and an eccentric sleeve. The transmitting sheath is connected to the driving shaft and has two positioning recesses and a receiving chamber. The transmitting shaft has at least one engaging face. The eccentric sleeve is movably mounted around the transmitting sheath and has at least one positioning slice abutting against the transmitting sheath in one of the positioning recesses and an engaging ring mounted in the eccentric sleeve, mounted around the transmitting shaft, and having at least one pressing arm selectively pressed against the transmitting shaft at the at least one engaging face.

Other objects, advantages and novel features of the invention will become more apparent from the following detailed description when taken in conjunction with the accompanying drawings.

DETAILED DESCRIPTION OF THE PREFERRED EMBODIMENT

Figure 1:
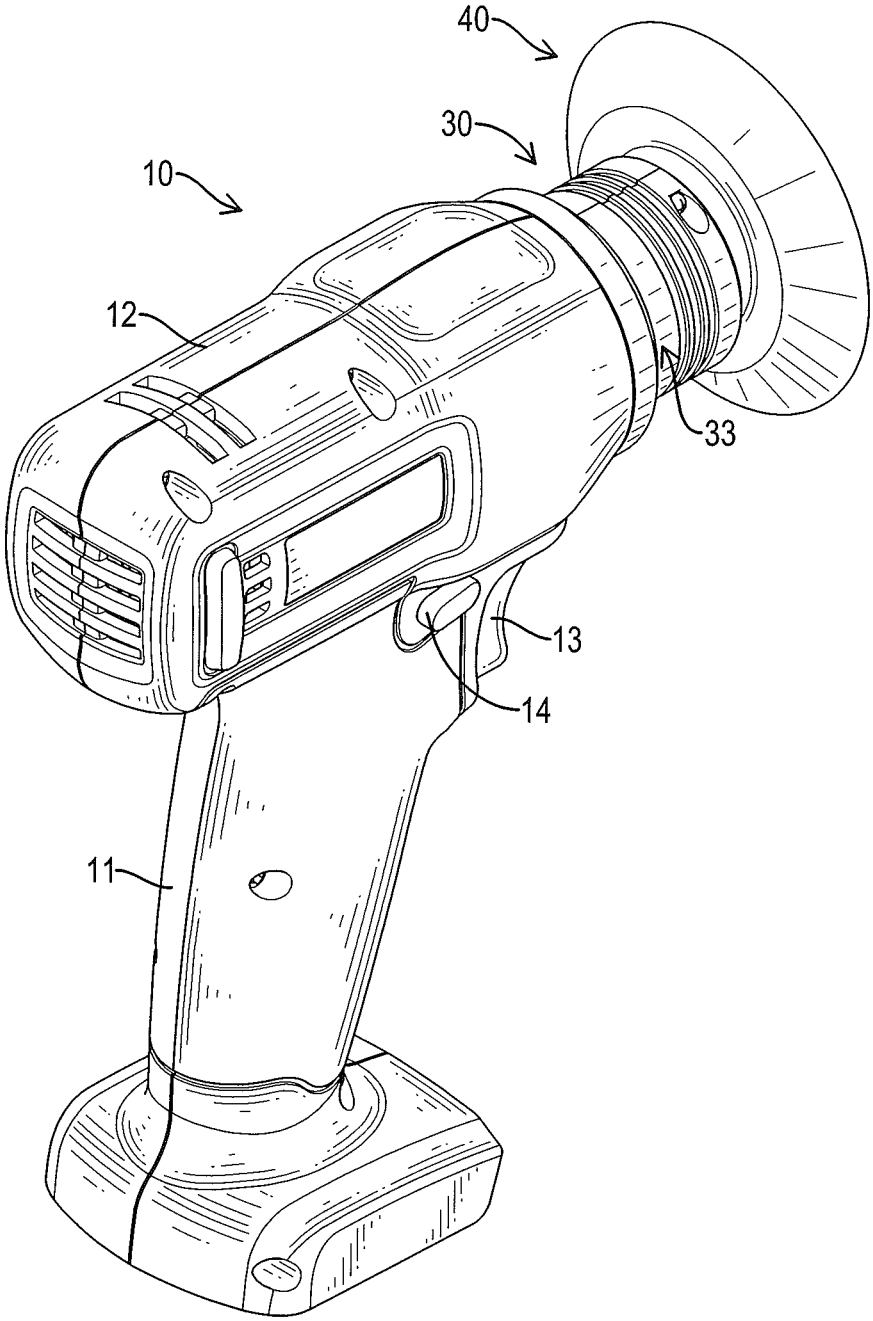
FIG. 1 is a perspective view of a handheld abrader in accordance with the present invention.
Figure 2:
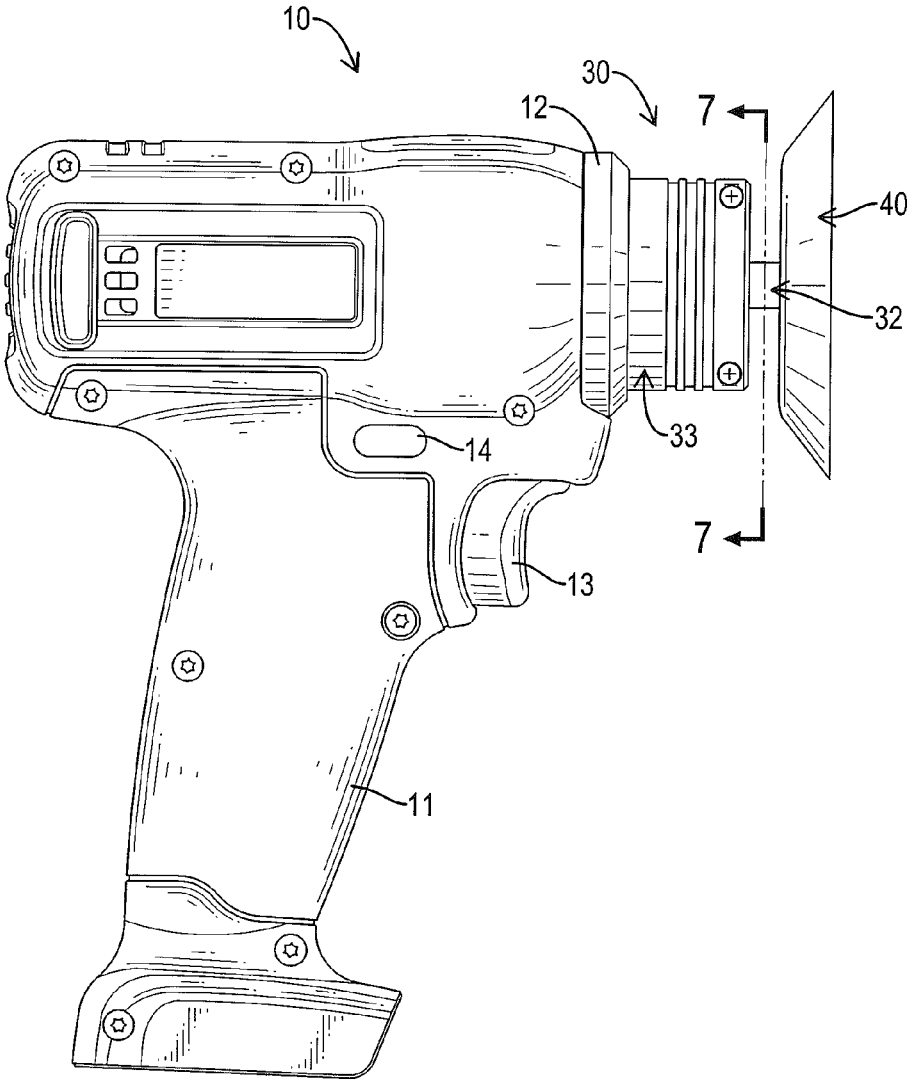
FIG. 2 is a side view of the handheld abrader in FIG. 1.

With reference to FIGS. 1 and 2, a handheld abrader in accordance with the present invention comprises a body 10, a driving device 20, an eccentric device 30, and a grinding tray 40.

The body 10 may be in a gun shape and has a handle 11 and a gun body 12. The handle 11 has at least one controlling unit such as a pressing button 13 or a toggle button 14. The at least one controlling unit is conventional and the features and the structures of the at least one controlling unit are not described in detail. The gun body 12 is formed with the handle 11 and has a mounting chamber 121.

The driving device 20 is mounted in the mounting chamber 121 of the gun body 12, and is electrically connected to the at least one controlling unit of the handle 11 to control a rotating direction of the driving device 20. The driving device 20 has a driving shaft 21 rotatably mounted in the gun body 12 of the body 10. The driving shaft 21 has an outer end and a connecting recess 211. The outer end of the driving shaft 21 extends out of a front side of the gun body 12 and has a front side. The connecting recess 211 is formed in the front side of the outer end of the driving shaft 21. In addition, the driving shaft 21 has an inner thread formed in the connecting recess 211.

Figure 3:
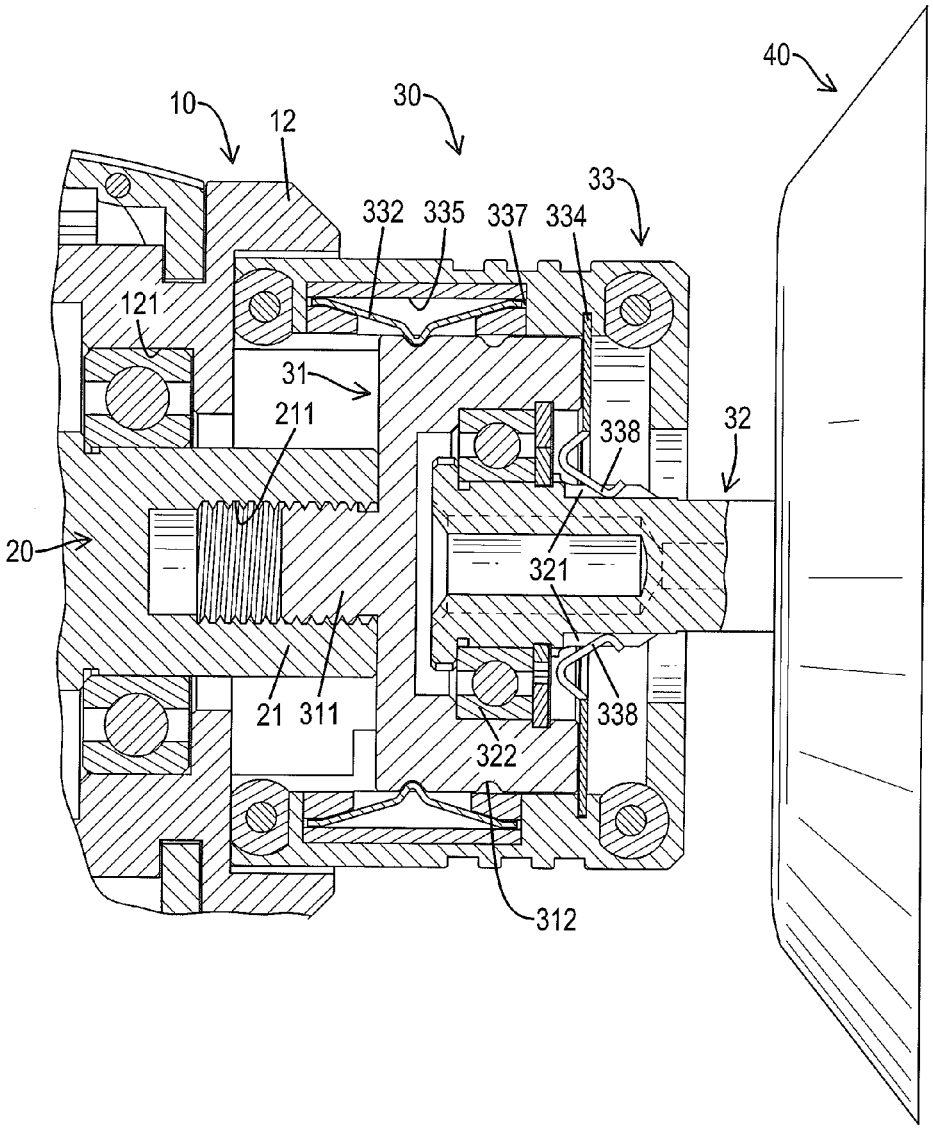
FIG. 3 is an enlarged side view in partial section of the handheld abrader in FIG. 2.
Figure 4:
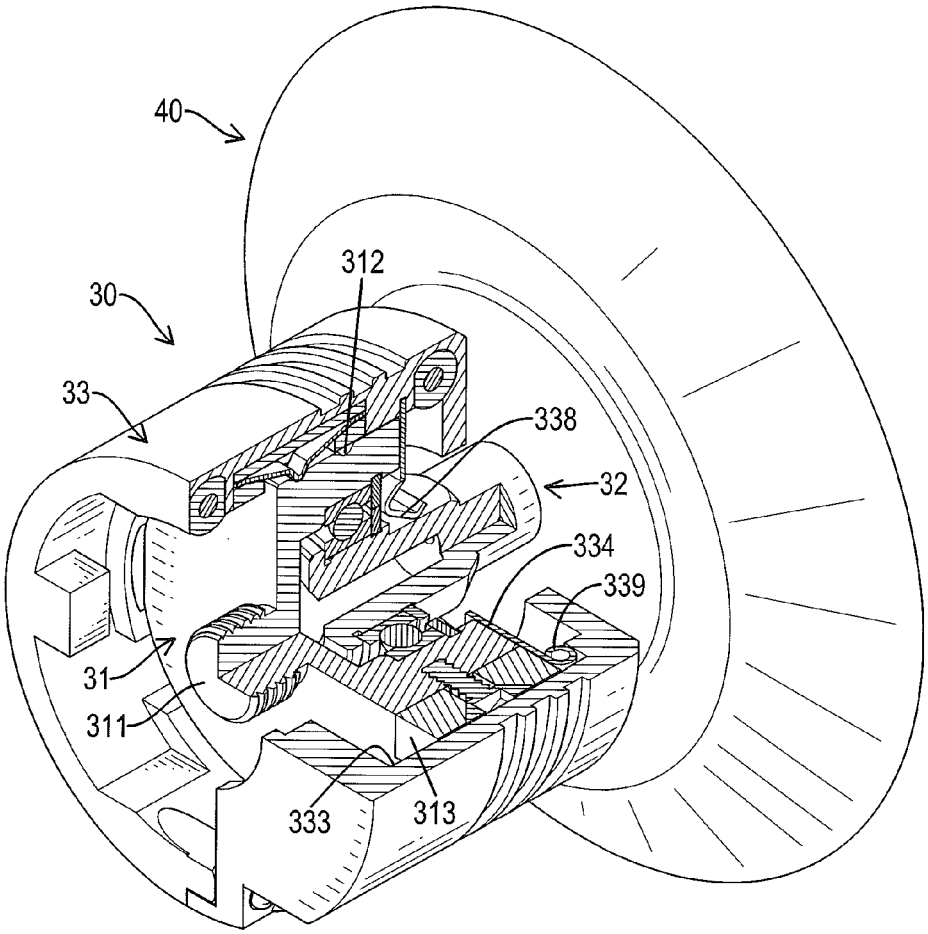
FIG. 4 is an enlarged perspective view of the handheld abrader in FIG. 3.
Figure 5:
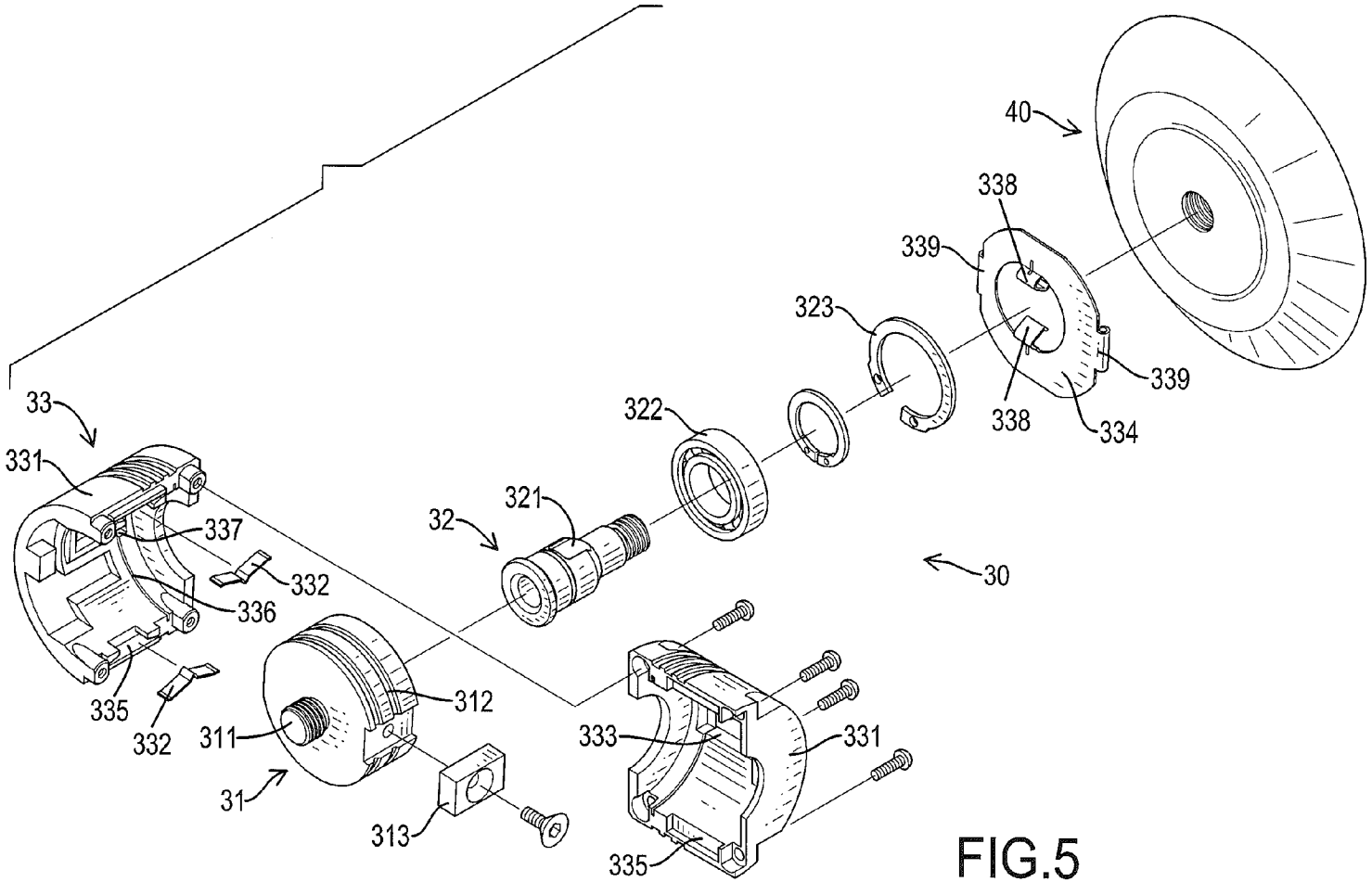
FIG. 5 is an exploded perspective view of the handheld abrader in FIG. 4.

With reference to FIGS. 3 to 5, the eccentric device 30 is connected to the driving device 20 at a front side of the body 10, and has a transmitting sheath 31, a transmitting shaft 32, and an eccentric sleeve 33.

The transmitting sheath 31 is connected to the driving shaft 21 at the front side of the gun body 12, and has a rear side, a front side, an outer surface, a connecting rod 311, two positioning recesses 312, a guiding block 313, and a receiving chamber 314. The rear side of the transmitting sheath 31 faces the outer end of the driving shaft 21. The connecting rod 311 is formed on and protrudes from the rear side of the transmitting sheath 31 and is connected to the connecting recess 211 of the driving shaft 21 to enable the transmitting sheath 31 to rotate with the driving shaft 21 relative to the body 10.

Figure 6:
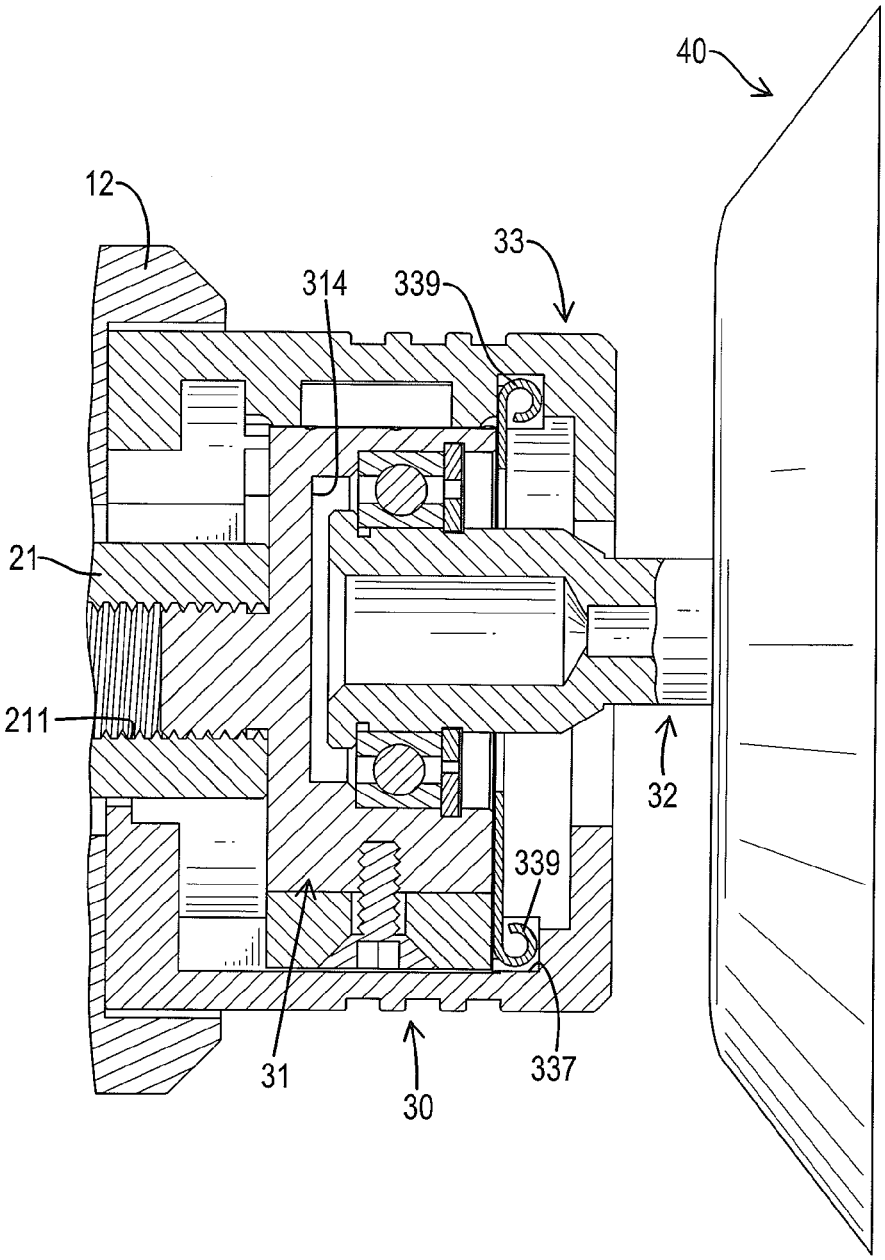
FIG. 6 is another enlarged side view in partial section of the handheld abrader in FIG. 2.

In addition, the connecting rod 311 has an outer thread screwed with the inner thread in the connecting recess 211 of the driving shaft 21 to connect the transmitting sheath 31 securely with the driving shaft 21. The two positioning recesses 312 are annularly formed in the outer surface of the transmitting sheath 31 at a spaced interval. The guiding block 313 is mounted on the outer surface of the transmitting sheath 31. With reference to FIG. 6, the receiving chamber 314 is formed in the front side of the transmitting sheath 31 and is set eccentrically relative to the driving shaft 21.

Figure 7:
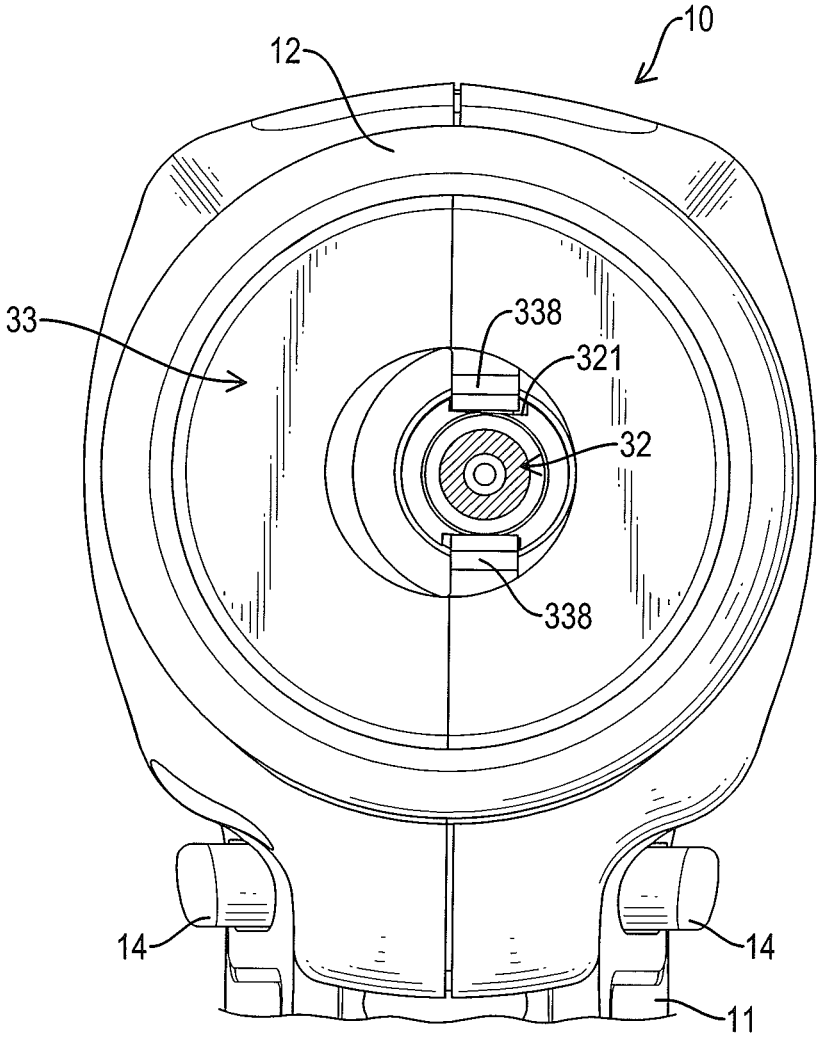
FIG. 7 is a cross sectional side view of the handheld abrader along line 7-7 in FIG. 2.

The transmitting shaft 32 is mounted in the receiving chamber 314 of the transmitting sheath 31 and has an external surface, a front end, an engaging segment, a bearing 322, and at least one C-ring 323. The front end of the transmitting shaft 32 extends out of the receiving chamber 314 of the transmitting sheath 31. The engaging segment is formed on the external surface of the transmitting shaft 32 that extends out of the transmitting sheath 31. In addition, the engaging segment has at least one engaging face 321 formed on the external surface of the transmitting shaft 32 that extends out of the transmitting sheath 31. Furthermore, the transmitting shaft 32 may have two engaging faces 321 formed on the external surface of the transmitting shaft 32 at the engaging segment of the transmitting shaft 32. The bearing 322 and the at least one C-ring are mounted around the transmitting shaft 32, and are mounted in the receiving chamber 314 of the transmitting sheath 31 to hold the transmitting shaft 32 with the transmitting sheath 31. Additionally, with reference to FIG. 7, the receiving chamber 314 is eccentrically formed in the transmitting sheath 31 relative to the driving shaft 21, and this ensures the transmitting shaft 32 is eccentrically mounted in the receiving chamber 314 relative to the driving shaft 21.

The eccentric sleeve 33 is movably mounted around the transmitting sheath 31, and the front end of the transmitting shaft 32 extends out of a front side of the eccentric sleeve 33. In addition, the eccentric sleeve 33 may be formed by two half-casings 331. The eccentric sleeve 33 has an internal surface, a front side, at least one positioning slice 332, a guiding recess 333, and an engaging element. The at least one positioning slice 332 is mounted on the internal surface of the eccentric sleeve 33 and abuts against the transmitting sheath 31 in one of the positioning recesses 312. In addition, the at least one positioning slice 332 may be a V-shaped elastic sheet.

Furthermore, the eccentric sleeve 33 has at least one embedded slot 335 formed in the internal surface of the eccentric sleeve 33, and the at least one positioning slice 332 is securely mounted in the at least one embedded slot 335 to hold the at least one positioning slice 332 in the eccentric sleeve 33. Additionally, the eccentric sleeve 33 has two embedded slots 335 formed in the internal surface of the eccentric sleeve 33 and two positioning slices 332 respectively mounted in the two embedded slots 335. Furthermore, the two positioning slices 332 are mounted on the internal surface of the eccentric sleeve 33 at a spaced interval and abut against the outer surface of the transmitting sheath 31 in the same positioning recess 312.

The guiding recess 333 is axially formed in the internal surface of the eccentric sleeve 33 and is disposed around the guiding block 313 of the transmitting sheath 31. In addition, the guiding recess 333 has a length along an axis direction of the transmitting shaft 32 longer than a length of the guiding block 313. Then, the eccentric sleeve 33 may be moved relative to the transmitting sheath 31 by the length difference between the eccentric sleeve 33 and the transmitting sheath 31, and the eccentric sleeve 33 may be rotated with the transmitting sheath 31 by the guiding recess 333 disposed around the guiding block 313.

Furthermore, the eccentric sleeve 33 has a fixing slot 336 and at least one engaging groove 337. The fixing slot 336 is formed in the internal surface of the eccentric sleeve 33 adjacent to the front side of the eccentric sleeve 33. The at least one engaging groove 337 is formed in the internal surface of the eccentric sleeve 33 and communicates with the fixing slot 336. Additionally, the eccentric sleeve 33 has two engaging grooves 337 formed in the internal surface of the eccentric sleeve 33 at a spaced interval and communicating with the fixing slot 336.

The engaging element is securely mounted in the eccentric sleeve 33 and selectively engages the engaging segment of the transmitting shaft 32 to enable the eccentric sleeve 33 to rotate with the transmitting shaft 32. Furthermore, the engaging element has an engaging ring 334 securely mounted in the fixing slot 336 of the eccentric sleeve 33, mounted around the transmitting shaft 32, and having a through hole, an outer periphery, at least one pressing arm 338, and at least one holding segment 339. The through hole is formed through the engaging ring 334 and is disposed around the transmitting shaft 32. The at least one pressing arm 338 is formed on and protrudes from the engaging ring 334 adjacent to the through hole, extends into the through hole, and selectively presses against the transmitting shaft 32 at the at least one engaging face 321 to enable the eccentric sleeve 33 to rotate with the transmitting shaft 32. Furthermore, the engaging ring 334 has two pressing arms 338 formed on the engaging ring 334 adjacent to the through hole and selectively pressed against the transmitting shaft 32 respectively at the engaging faces 321 of the transmitting shaft 32.

The at least one holding segment 339 is formed on and protrudes from the outer periphery of the engaging ring 334 and is mounted in the at least one engaging groove 337 to hold the engaging ring 334 securely on the internal surface of the eccentric sleeve 33. In addition, the engaging ring 334 has two holding segments 339 formed on and protruding from the outer periphery of the engaging ring 334 at a spaced interval and respectively mounted in the two engaging grooves 337 of the eccentric sleeve 33.

The grinding tray 40 is connected to the transmitting shaft 32 of the eccentric device 30 at the front side of the eccentric sleeve 33 to rotate relative to the body 10 by the driving device 20.

With reference to FIGS. 3 and 4, when the eccentric sleeve 33 is moved relative to the transmitting sheath 31 toward the gun body 12, the at least one positioning slice 332 is moved with the eccentric sleeve 33 and abuts against the transmitting sheath 31 in the positioning recess 312 that is adjacent to the driving shaft 21. At the same time, the engaging ring 334 is moved with the eccentric sleeve 33 relative to the transmitting shaft 32 to enable the at least one pressing arm 338 of the engaging ring 334 to press against the transmitting shaft 32 at the at least one engaging face 321 to hold the transmitting shaft 32 with the eccentric sleeve 33. Then, the eccentric sleeve 33 and the transmitting shaft 32 are set in an engaging condition.

With reference to FIG. 2, when the pressing button 13 is pressed to operate the driving device 20, the driving shaft 21 is rotated relative to the gun body 12. Since the connecting rod 311 of the transmitting sheath 31 is securely connected to the connecting recess 211 of the driving shaft 21, the transmitting sheath 31 is rotated with the driving shaft 21 relative to the gun body 12. When the transmitting sheath 31 is rotated with the driving shaft 21, the eccentric sleeve 33 is rotated with the transmitting sheath 31 since the guiding block 313 of the transmitting sheath 31 is mounted in the guiding recess 333 of the eccentric sleeve 33.

When the grinding tray 40 abuts against an object to grind or polish a surface of the object, a rotating force of the driving shaft 21 is transmitted to the grinding tray 40 via the transmitting sheath 31 and the transmitting shaft 32. Then, the grinding tray 40 is rotated relative to the object to grind or polish the surface of the object. During the above-mentioned grinding process, since the at least one pressing arm 338 presses against the transmitting shaft 32 at the at least one engaging face 321 to hold the transmitting shaft 32 with the eccentric sleeve 33, this enables an eccentric rotating force of the eccentric sleeve 33 to transmit to the transmitting shaft 32. Then, the transmitting shaft 32 has a larger torque to transmit to the grinding tray 40 and this enables the object to be grinded or polished in a rough grinding way.

Figure 8:
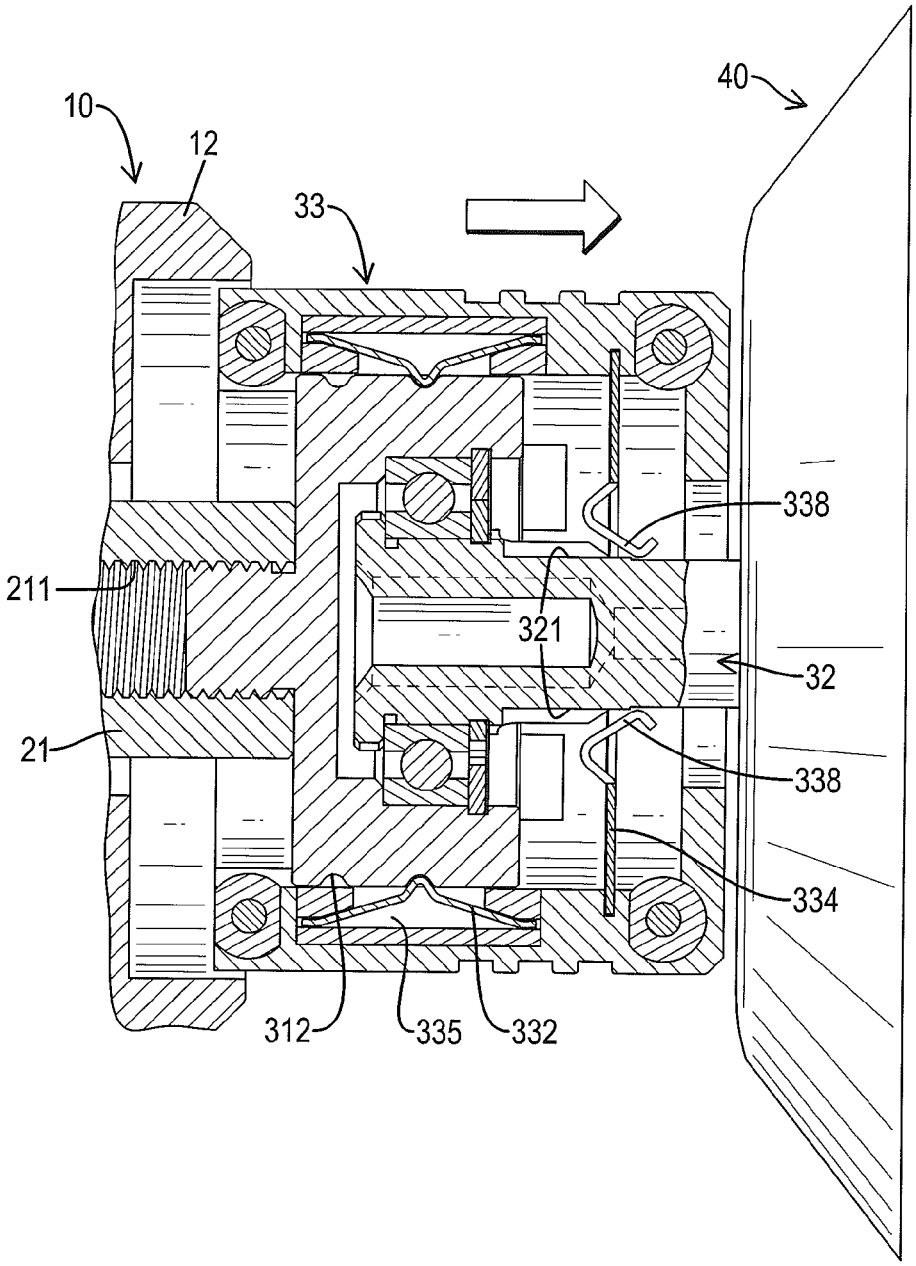
FIG. 8 is an enlarged and operational side view in partial section of the handheld abrader in FIG. 1.

With reference to FIG. 8, when the object needs to be grinded or polished in a fine grinding way, the eccentric sleeve 33 is pushed to move relative to the transmitting sheath 31 toward the grinding tray 40, and the at least one positioning slice 332 is moved with the eccentric sleeve 33 and abuts against the transmitting sheath 31 in the positioning recess 312 that is adjacent to the grinding tray 40. At the same time, the at least one pressing arm 338 of the engaging ring 334 is separated from the at least one engaging face 321 of the transmitting shaft 32. Then, the eccentric sleeve 33 and the transmitting shaft 32 are set in a separating condition.

When the pressing button 13 is pressed to operate the driving device 20, the rotating force of the driving shaft 21 is transmitted to the transmitting shaft 32 via the transmitting sheath 31. Since the at least one pressing arm 338 is not pressed against the transmitting shaft 32 at the at least one engaging face 321, the transmitting shaft 32 is not held with the eccentric sleeve 33. Then, the eccentric rotating force of the eccentric sleeve 33 may not transmit to the transmitting shaft 32, and this enables the transmitting shaft 32 to rotate with the transmitting sheath 31 without the eccentric sleeve 33. Therefore, the object is grinded or polished by the grinding tray 40 with a smaller torque in a fine grinding way.

According to the above-mentioned features and structural relationship of the handheld abrader, the torque of the handheld abrader may be adjusted according to the user's need by changing the position of the eccentric sleeve 33 relative to the transmitting sheath 31. Then, the at least one pressing arm 338 of the eccentric sleeve 33 presses against or separates from the at least one engaging face of the transmitting shaft 32 to change the conditions between the transmitting sheath 31 and the eccentric sleeve 33 in an engaging condition (larger torque) or a separating condition (smaller torque). Consequently, the single handheld abrader can be used with different torques to grind or polish the object by different grinding ways according to the user's need without replacing or buying other handheld abraders with different torques, and this may decrease the cost of use and may improve the applicability of the handheld abrader.

Even though numerous characteristics and advantages of the present invention have been set forth in the foregoing description, together with details of the structure and features of the invention, the disclosure is illustrative only. Changes may be made in the details, especially in matters of shape, size, and arrangement of parts within the principles of the invention to the full extent indicated by the broad general meaning of the terms in which the appended claims are expressed.

What is claimed is:

1. A handheld abrader having:

a body having
- a handle; and
- a gun body formed with the handle and having
  - a front side; and
  - a mounting chamber formed in the gun body;

a driving device mounted in the mounting chamber of the gun body and having
- a driving shaft rotatably mounted in the gun body of the body and having an outer end extending out of the front side of the gun body;

an eccentric device connected to the driving device at a front side of the body, and having
- a transmitting sheath connected to the driving shaft at the front side of the gun body, and having
  - a rear side facing the outer end of the driving shaft;
  - a front side;
  - an outer surface; and
  - a receiving chamber formed in the front side of the transmitting sheath and set eccentrically relative to the driving shaft;
- a transmitting shaft mounted in the receiving chamber of the transmitting sheath and having
  - an external surface;
  - a front end extending out of the receiving chamber of the transmitting sheath; and
  - an engaging segment formed on the external surface of the transmitting shaft that extends out of the transmitting sheath; and
- an eccentric sleeve movably mounted around the transmitting sheath to enable the front end of the transmitting shaft to extend out of the eccentric sleeve, and having
  - an internal surface;
  - a front side; and
  - an engaging element securely mounted in the eccentric sleeve and selectively engaging the engaging segment of the transmitting shaft to enable the eccentric sleeve to rotate with the transmitting shaft, mounted around the transmitting shaft, and having
    - a through hole formed through the engaging element and disposed around the transmitting shaft;
    - an outer periphery; and
    - at least one pressing arm formed on and protruding from the engaging element adjacent to the through hole, extending into the through hole, and selectively pressed against the transmitting shaft to hold the transmitting shaft with the eccentric sleeve to enable the transmitting shaft to rotate with the eccentric sleeve; and a grinding tray connected to the transmitting shaft of the eccentric device at the front side of the eccentric sleeve to rotate relative to the body by the driving device.

2. The handheld abrader as claimed in claim 1, wherein the engaging segment of the transmitting shaft has at least one engaging face formed on the external surface of the transmitting shaft that extends out of the transmitting sheath; and the engaging element is an engaging ring, is securely mounted in the eccentric sleeve, and has
- a through hole formed through the engaging ring and disposed around the transmitting shaft; and
- at least one pressing arm formed on and protruding from the engaging ring adjacent to the through hole, extending into the through hole, and selectively pressing against the transmitting shaft at the at least one engaging face to enable the eccentric sleeve to rotate with the transmitting shaft.

3. The handheld abrader as claimed in claim 1, wherein the transmitting sheath has two positioning recesses annularly formed in the outer surface of the transmitting sheath at a spaced interval; and the eccentric sleeve has at least one positioning slice mounted on the internal surface of the eccentric sleeve and abutting against the transmitting sheath in one of the positioning recesses.

4. The handheld abrader as claimed in claim 2, wherein the transmitting sheath has two positioning recesses annularly formed in the outer surface of the transmitting sheath at a spaced interval; and the eccentric sleeve has at least one positioning slice mounted on the internal surface of the eccentric sleeve and abutting against the transmitting sheath in one of the positioning recesses.

5. The handheld abrader as claimed in claim 3, wherein the transmitting sheath has a guiding block mounted on the outer surface of the transmitting sheath;

the eccentric sleeve has a guiding recess axially formed in the internal surface of the eccentric sleeve, disposed around the guiding block of the transmitting sheath, and having a length along an axis direction of the transmitting shaft being longer than a length of the guiding block; and wherein the eccentric sleeve is moved relative to the transmitting sheath by the length difference between the eccentric sleeve and the transmitting sheath, and the eccentric sleeve is rotated with the transmitting sheath by the guiding recess disposed around the guiding block.

6. The handheld abrader as claimed in claim 4, wherein the transmitting sheath has a guiding block mounted on the outer surface of the transmitting sheath;

the eccentric sleeve has a guiding recess axially formed in the internal surface of the eccentric sleeve, disposed around the guiding block of the transmitting sheath, and having a length along an axis direction of the transmitting shaft being longer than a length of the guiding block; and wherein the eccentric sleeve is moved relative to the transmitting sheath by the length difference between the eccentric sleeve and the transmitting sheath, and the eccentric sleeve is rotated with the transmitting sheath by the guiding recess disposed around the guiding block.

7. The handheld abrader as claimed in claim 5, wherein the transmitting shaft has two engaging faces formed on the external surface of the transmitting shaft; and the engaging ring has two pressing arms formed on the engaging ring adjacent to the through hole and selectively pressed against the transmitting shaft respectively at the two engaging faces of the transmitting shaft.

8. The handheld abrader as claimed in claim 6, wherein the transmitting shaft has two engaging faces formed on the external surface of the transmitting shaft; and the engaging ring has two pressing arms formed on the engaging ring adjacent to the through hole and selectively pressed against the transmitting shaft respectively at the two engaging faces of the transmitting shaft.

9. The handheld abrader as claimed in claim 7, wherein the eccentric sleeve has a fixing slot formed in the internal surface of the eccentric sleeve adjacent to the front side of the eccentric sleeve; and the engaging ring is securely mounted in the fixing slot of the eccentric sleeve.

10. The handheld abrader as claimed in claim 8, wherein the eccentric sleeve has a fixing slot formed in the internal surface of the eccentric sleeve adjacent to the front side of the eccentric sleeve; and the engaging ring is securely mounted in the fixing slot of the eccentric sleeve.

11. The handheld abrader as claimed in claim 9, wherein the eccentric sleeve has at least one engaging groove formed in the internal surface of the eccentric sleeve and communicating with the fixing slot; and the engaging ring has at least one holding segment formed on and protruding from the outer periphery of the engaging ring and mounted in the at least one engaging groove to hold the engaging ring securely on the internal surface of the eccentric sleeve.

12. The handheld abrader as claimed in claim 10, wherein the eccentric sleeve has at least one engaging groove formed in the internal surface of the eccentric sleeve and communicating with the fixing slot; and the engaging ring has at least one holding segment formed on and protruding from the outer periphery of the engaging ring and mounted in the at least one engaging groove to hold the engaging ring securely on the internal surface of the eccentric sleeve.

13. The handheld abrader as claimed in claim 11, wherein the eccentric sleeve has at least one embedded slot formed in the internal surface of the eccentric sleeve; and the at least one positioning slice is securely mounted in the at least one embedded slot to hold the at least one positioning slice in the eccentric sleeve.

14. The handheld abrader as claimed in claim 12, wherein the eccentric sleeve has at least one embedded slot formed in the internal surface of the eccentric sleeve; and the at least one positioning slice is securely mounted in the at least one embedded slot to hold the at least one positioning slice in the eccentric sleeve.

15. The handheld abrader as claimed in claim 13, wherein the eccentric sleeve has two embedded slots formed in the internal surface of the eccentric sleeve; and two positioning slices respectively mounted in the two embedded slots, mounted on the internal surface of the eccentric sleeve at a spaced interval, and abutting against the outer surface of the transmitting sheath in a same positioning recess.

16. The handheld abrader as claimed in claim 14, wherein the eccentric sleeve has two embedded slots formed in the internal surface of the eccentric sleeve; and two positioning slices respectively mounted in the two embedded slots, mounted on the internal surface of the eccentric sleeve at a spaced interval, and abutting against the outer surface of the transmitting sheath in a same positioning recess.

17. The handheld abrader as claimed in claim 15, wherein the outer end of the driving shaft has a front side;

the driving shaft has a connecting recess formed in the front side of the outer end of the driving shaft; and the transmitting sheath has a connecting rod formed on and protruding from the rear side of the transmitting sheath and connected to the connecting recess of the driving shaft to enable the transmitting sheath to rotate with the driving shaft relative to the body.

18. The handheld abrader as claimed in claim 16, wherein the outer end of the driving shaft has a front side;

the driving shaft has a connecting recess formed in the front side of the outer end of the driving shaft; and the transmitting sheath has a connecting rod formed on and protruding from the rear side of the transmitting sheath and connected to the connecting recess of the driving shaft to enable the transmitting sheath to rotate with the driving shaft relative to the body.

19. The handheld abrader as claimed in claim 17, wherein the transmitting shaft has a bearing mounted around the transmitting shaft and mounted in the receiving chamber of the transmitting sheath; and at least one C-ring mounted around the transmitting shaft and mounted in the receiving chamber of the transmitting sheath adjacent to the bearing; and the eccentric sleeve is formed by two half-casings.

20. The handheld abrader as claimed in claim 18, wherein the transmitting shaft has a bearing mounted around the transmitting shaft and mounted in the receiving chamber of the transmitting sheath; and at least one C-ring mounted around the transmitting shaft and mounted in the receiving chamber of the transmitting sheath adjacent to the bearing; and the eccentric sleeve is formed by two half-casings.

* * * * *